US007271217B2

(12) United States Patent
Li

(10) Patent No.: US 7,271,217 B2
(45) Date of Patent: Sep. 18, 2007

(54) PHYTOPROTEIN SYNTHETIC FIBRE AND METHOD OF MANUFACTURE THEREOF

(76) Inventor: Guanqi Li, No. 59, Jingkai Raod, Puyang City, Henan Province (CN) 457000

( * ) Notice: Subject to any disclaimer, the term of this patent is extended or adjusted under 35 U.S.C. 154(b) by 0 days.

(21) Appl. No.: 10/883,607

(22) Filed: Jul. 1, 2004

(65) Prior Publication Data

US 2005/0014895 A1 Jan. 20, 2005

Related U.S. Application Data

(63) Continuation of application No. PCT/CN02/00943, filed on Dec. 31, 2002.

(30) Foreign Application Priority Data

Jan. 4, 2002 (CN) ..... 02 1 09966

(51) Int. Cl.
*C08F 16/06* (2006.01)
*C08F 116/06* (2006.01)
*D01F 8/02* (2006.01)

(52) U.S. Cl. ..... 525/56; 525/54.42; 525/54.44; 525/56; 525/58; 525/61

(58) Field of Classification Search ..... 525/54.42, 525/54.44, 56, 58, 61
See application file for complete search history.

(56) References Cited

U.S. PATENT DOCUMENTS 5,523,293 A 6/1996 Jane et al.
5,580,499 A 12/1996 Uy

FOREIGN PATENT DOCUMENTS

| | | | |
|---|---|---|---|
| CN | 1062934 A | | 7/1992 |
| CN | 1286325 A | | 3/2001 |
| CN | 1308151 A | | 8/2001 |
| CN | 1309199 | * | 8/2001 |
| CN | 1354291 | * | 6/2002 |
| CN | 1372024 | * | 10/2002 |
| GB | 1470047 A | | 4/1997 |
| JP | 6-220713 A | | 8/1994 |

* cited by examiner

*Primary Examiner*—Ana Woodward
(74) *Attorney, Agent, or Firm*—Yi Li

(57) ABSTRACT

This invention relates to a phytoprotein synthetic fiber and the method for the manufacture thereof. This synthetic fiber is composed of phytoprotein and polyvinyl alcohol, the phytoprotein comprising A parts of the two components, where A is equal to or greater than 5 parts and less than 23 parts, and the polyvinyl alcohol comprising B parts, where B is greater than 77 parts and equal to or less than 95 parts. The methods of manufacturing the synthetic fiber comprise a semi-finished product manufacturing process and a semi-finished product acetalization and finishing process. The sequence of processing of the semi-finished product is as follows: taking a spinning dope prepared from proportions of phytoprotein and polyvinyl alcohol, and after deaeration introducing the spinning dope to a wet-spinning frame to undergo wet-spinning; the synthetic fiber output by the spinning frame then entering a coagulant bath, the semi-finished product being obtained after air drafting, wet bath drafting, drying, dry heat drafting and heat fixing. The synthetic fibers produced as a result of the adoption of this method exhibit good breathability characteristics and require a production period of short duration, thus increasing productivity.

6 Claims, No Drawings

PHYTOPROTEIN SYNTHETIC FIBRE AND METHOD OF MANUFACTURE THEREOF

CROSS-REFERENCE TO RELATED APPLICATIONS

This application is a continuation of PCT Application No. PCT/CN02/00943, filed Dec. 31, 2002, which claims priority of People's Republic of China Application No. 02109966.9, filed Jan. 4, 2002, which is hereby incorporated herein in its entirety by reference.

TECHNICAL FIELD

This invention relates to a certain type of textile material and the method of manufacture thereof. To be precise, it relates to a certain type of synthetic textile fibre containing phytoprotein and the methods of producing this synthetic fibre.

BACKGROUND ART

Apart from natural silk, textile threads composed of fibres containing protein of which there is general knowledge include a certain type of lactose composite silk which was disclosed in Japan in "Fibrous Protein Chemistry" and which was based on protein extracted from cow's milk. This protein was mixed with acrylonitrile to form a composite lactose silk. Due to the use of animal proteins as raw material in this type of composite silk this product was extremely expensive.

In order to make the best use of available resources, and in order to reduce the cost of composite silk whilst ensuring that products retain acceptable characteristics, the present inventor has already disclosed a certain type of phytoprotein composite silk and the method of its manufacture in Chinese patent 99116636.1, and this type of composite silk possessed characteristics similar to silk; the phytoprotein content of this type of composite silk was between 23-55 of the overall content. However, after further research and trial-production by the present inventor, it was discovered that there was a still greater potential for development of composite silk based on phytoprotein; the synthetic fibres thus produced exhibited even better properties than current composite silks, for instance in terms of breathability. In addition, due to the relatively long duration of the production cycle involved in the manufacturing method outlined by the above-mentioned patent, the yield was relatively low.

SUMMARY OF THE INVENTION

The main object of this invention relating to phytoprotein synthetic fibre is to provide a synthetic fibre with optimum breathability, exhibiting characteristics similar to cashmere.

The main object of the phytoprotein synthetic fibre manufacturing method provided by this invention is to resolve the problems of the lengthy production cycle and low yield associated with current manufacturing methods.

The phytoprotein synthetic fibre provided by this invention is composed of phytoprotein and polyvinyl alcohol, phytoprotein making up A parts of the two materials, where A is equal to or greater than 5 parts and less than 23 parts, and polyvinyl alcohol making up B parts, where B is greater than 77 parts and equal to or less than 95 parts.

Furthermore, a preferable proportion of phytoprotein to the total content of materials is A parts, where A is equal to or greater than 5 parts and equal to or less 22 parts; polyvinyl alcohol constitutes B parts of the total content of materials, where B is equal to or greater than 78 parts and equal to or less than 95 parts. The optimum proportion of phytoprotein to the total content of materials is A parts, where A is equal to or greater than 10 and equal to or less than 18; polyvinyl alcohol making up B parts of the total content of materials, where B is equal to or greater than 82 parts and equal to or less than 90 parts.

Most preferably, apart from the aforementioned phytoprotein being a protein extracted from soya beans, peanuts, or cottonseed or rapeseed cake or maize germ or walnuts or sunflower seeds, it may also rely on protein isolated and extracted directly from soya beans or peanuts or cottonseed or rapeseed by soaking and wet grinding, or it may also rely on protein isolated and extracted by crushing, degreasing and soaking, or it may also rely on protein isolated and extracted by germ pressing, followed by fragmentation and decreasing.

The phytoprotein synthetic fibre manufacturing method provided by this invention encompasses a semi-finished product manufacturing process and a semi-finished product acetalization and finishing process which yield the finished product and can be characterised as follows: the steps for manufacturing the semi-finished product are:

a. Preparation of a proportioned spinning dope of phytoprotein and polyvinyl alcohol, such proportioning resulting in phytoprotein making up A parts of the total content of the two components, where A is equal to or greater than 5 parts and less than 23 parts, and polyvinyl alcohol making up B parts of the total content of the two components, where B is greater than 77 parts and equal to or less than 95 parts;

b. Wet-spinning on a wet-spinning frame after deaerating the spinning dope;

c. Introduction of the synthetic fibre obtained from the spinning frame to a coagulant bath, then air drafting, wet bath drafting, drying, dry heat drafting and heat fixing to obtain the semi-finished product.

In the aforementioned phytoprotein synthetic fibre manufacturing method,

The spinning dope mentioned is prepared according to the following steps: weighing out pure protein and polyvinyl alcohol according to proportions, followed by formation of a solution by direct addition of these two raw-materials to distilled water, followed by the addition of borax or boric acid, then mixing at a temperature T4, T4 being equal to or greater than 40° C. and less than 98° C., yielding the spinning dope;

In the aforementioned step b the deaeration of the spinning dope may be carried out according to the following steps: by allowing the spinning dope to stand at a temperature Tj and at normal atmospheric pressure, Tj being equal to or greater than 50° C. and less than 80° C. for a length of time (tj) equal to or greater than 1.5 hours and less than 4 hours to allow static deaeration, or by carrying out vacuum deaeration at a temperature of between 30° C. and 45° C.; in addition in the aforementioned step c, the coagulant bath through which the synthetic fibre passes is a salt and alkali aqueous solution.

In said phytoprotein synthetic fibre manufacturing method, the spinning dope mentioned in step a is prepared according to the following steps:

firstly taking the extracted purified protein dissolved in distilled water to form a protein solution of concentration As, where As is equal to or greater than 4% and equal to or less than 15%, at the same time dissolving polyvinyl alcohol for a time t1 in distilled water at temperature T1, where T1 is equal to or greater than 40° C. and less than 98° C. and where t1 is greater than 1.5 hours and equal to or less than 3 hours, to form an aqueous solution of concentration Bs, where Bs is greater than 20% and equal to or less than 30%, or where Bs is equal to or greater than 8% and less than 15%; following this, borax is added to the proportioned solution of the two aforementioned materials, which is then mixed thoroughly at a temperature T4, where T4 is equal to or greater than 40° C. and less than 98° C., to yield the spinning dope;

the deaeration of the spinning dope prepared in step b is carried out according to the following steps: allowing the spinning dope to stand at a temperature Tj and at normal atmospheric pressure, Tj being equal to or greater than 50° C. and less than 80° C. for a length of time (tj) equal to or greater than 1.5 hours and less than 4 hours to allow static deaeration, or carrying out vacuum deaeration at a temperature of 30° C.-45° C.;

In steps b and c the wet-spinning spinneret velocity is V, where V is greater than 17 m/min and equal to or less than 30 m/min, and the coagulant bath into which the injected thread enters is a salt and alkali aqueous solution of which the salt content is P, where P is greater than 438 g/L and equal to or less than 480 g/L, and of which the alkali content is P4, where P4 is between 1 g/L and 40 g/L, whilst the temperature of the bath is T3, where T3 is equal to or greater than 32° C. and less than 38° C.

The aforementioned spinning dope may be alkaline, and the coagulant bath may be acidic, whilst the acid within the coagulant bath may be sulphuric acid and/or phosphoric acid.

The aforementioned spinning dope may alternatively be acidic, and the coagulant bath may be alkaline.

In aforementioned phytoprotein synthetic fibre manufacturing method, the alkaline spinning dope may be prepared according to the following steps:

(1) The purified isolated protein is dissolved in an alkaline solution at a temperature T2, that alkaline solution having a pH value equal to or greater than 7.5 and less than 8.5, and requiring a solution time of t2, where t2 is equal to or greater than 1 hour and less than 3 hours; and where T2 is equal to or greater than 40° C. and less than 98° C., yielding a protein solution with a concentration As, where As is equal to or greater than 4% and less than 15%;

(2) Dissolving the polyvinyl alcohol at a temperature (T1) equal to or greater than 40° C. and less than 98° C., for a duration t1, where t1 is equal to or greater than 1 hour and less than 2 hours, to yield a polyvinyl acetate solution with a concentration Bs, where Bs is equal to or greater than 8% and less than 15%. or greater than 20% and equal to or less than 30%:

(3) Finally, the mixing in proportion of the above two solutions, to obtain the spinning dope;

The steps for deaerating the spinning dope in the aforementioned step b are as follows:

allowing the spinning dope to stand at a temperature Tj and at normal atmospheric pressure, Tj being equal to or greater than 50° C. and less than 80° C. for a length of time (tj) equal to or greater than 1.5 hours and less than 4 hours to allow static deaeration, or carrying out vacuum deaeration at a temperature of 30° C.-45° C.; in addition in the aforementioned steps b and c the wet-spinning spinneret velocity is V, where V is greater than 17 /min and equal to or less than 30 m/min, and the coagulant bath into which the injected thread enters is a salt and acid aqueous solution of which the salt content is P, where P is greater than 438 g/L and equal to or less than 480 g/L, and of which the acid content is P1, where P1 is equal to or greater than 0.2 g/L and less than 0.26 g/L, whilst the temperature of the bath is T3, where T3 is equal to or greater than 30° C. and less than 38° C.

In the aforementioned phytoprotein synthetic fibre manufacturing method, the acidic spinning dope is prepared according to the following steps: purified extracted protein and polyvinyl alcohol are mixed together according to proportion in distilled water, and dissolved at a temperature T4 of between 40° C. and 98° C., yielding a solution containing a concentration of protein and polyvinyl alcohol between 8% to 25%, then by adding boric acid/ and/or phosphporic acid and mixing thoroughly yielding the acidic spinning dope with a pH of between 1 and 3.5 is obtained;

the deaeration of the spinning dope prepared in step b is carried out according to the following steps: vacuum deaeration or static deaeration of the spinning dope is carried out at a temperature between 30° C. and 58° C.;

in step c the alkaline coagulant bath into which the injected thread enters is a salt and alkali aqueous solution, the coagulant bath having a pH value of between 9 and 14, and a temperature T3 equal to or greater than 32° C. and less than 38° C.

In the aforementioned phytoprotein synthetic fibre manufacturing method, the alkaline spinning dope is prepare according to the following steps:

(1) A protein solution with a concentration As is prepared, where the concentration As is equal to or greater than 4% and less than 15%, and this solution is made slightly alkaline to a pH value equal to or greater then 7.5 and less than 8.5;

(2) Polyvinyl alcohol is measured out according to a proportion, this is then dissolved directly in the protein solution at a temperature Th and for a time t, where Th is equal to or greater than 40° C. and less than 98° C. and where t is equal to or greater than 1 hour and less than 4 hours, yielding a spinning dope with a concentration C2 of the two materials, where C2 is equal to or greater than 8% and less than 15%, or greater than 20% and equal to or less than 30%;

the deaeration of the spinning dope prepared in step b is carried out according to the following steps: vacuum deaeration of the spinning dope is carried out at a temperature of between 30° C. and 45° C., or static deaeration is carried out at a temperature Tj equal to or greater than 35° C. and less than 80° C.;

In the aforementioned step c, the acidic coagulant bath through which the synthetic fibre passes is a salt and acid aqueous solution.

In aforementioned phytoprotein synthetic fibre manufacturing method, the acidic spinning dope mentioned is prepared according to the following steps:

(1) Dissolving the protein in an acidic solution with a pH of between 1 and 3.5, yielding a protein solution with a concentration As, where As is equal to or greater than 4% and less than 15%.

(2) Dissolving the polyvinyl alcohol according to proportion directly in the above solution, yielding a spinning dope with a total protein and polyvinyl alcohol content of between 8% and 22%;

The steps for deaerating the spinning dope mentioned in step b are as follows:

carrying out vacuum deaeration of the spinning dope at a temperature of 30° C. to 58° C., or carrying out static deaeration;

in step c the alkaline coagulant bath into which the injected thread enters is a salt and alkali aqueous solution, the coagulant bath having a pH value of between 9 and 14, and a temperature (T3) equal to or greater than 36° C. and less than 38° C.

Apart from this, in the aforementioned phytoprotein synthetic fibre manufacturing method, the total elongation factor applied to the filament bundle as it undergoes air drafting, wet bath drafting and dry heat drafting after passing through the coagulation bath is between 4.5 and 8.5; the acetalizing bath is kept at a temperature T6 during the acetalizing step, where T6 is between 40° C. and 64° C., the acetalizing solution containing aldehyde, acid and ammonium sulphate, the aldehyde content P3 being between 5 g/L and 31.9 g/L, the acid content P10 being between 5 g/L and 239.8 g/L, and the salt content P11 being between 80 g/L and 119 g/L.

Moreover, during the acetalizing step, the aldehyde used in the acetalization solution can be either glyoxal or modified glutaraldehyde.

The synthetic fibre manufactured according to the proportions of phytoprotein and polyvinyl alcohol indicated by this invention exhibits excellent breathability characteristics, exhibits the softness of cashmere. What is more, the duration of the production cycle of the synthetic fibre disclosed here is shorter than that disclosed in Chinese patent 99116636.1. In order to increase yields, techniques suited to the extraction of a variety of different phytoproteins are adopted by this invention, making production of phytoprotein synthetic fibre even more convenient. This invention also has the comprehensive effect of increasing the value attached to agricultural products, whilst also opening up new areas of deep-processing of crops; this invention therefore constitutes an inventive creation with major inherent social benefits.

DETAILED DESCRIPTION

EXAMPLE 1

Firstly take soya beans and soak them in water, then employ wet grinding, then extract the phytoprotein. After this, place the extracted pure phytoprotein in a weak alkaline solution with a pH of 8.4, and dissolve at a temperature T2 of between 40° C. and 50° C., over a solution period t2 of 2.5 hours, to obtain a protein solution with a concentration (As), where As is equal to or greater than 4% and less than 15%. At the same time, add the polyvinyl alcohol to distilled water, and dissolve at a temperature T1 of between 79° C. and 97° C., for a duration t1 of 100 minutes, yielding a polyvinyl alcohol solution with a concentration Bs, where Bs is equal to or greater than 8% and less than 15%.

Taking the above two types of solution, mix in proportions so that the proportion of pure protein to total pure protein and polyvinyl alcohol is A parts, where A is 5 parts, and make the proportion of polyvinyl alcohol to the total solid content of the two materials B parts, where B is 95 parts. Then after mixing the above two solutions together at a temperature T4, where T4 is equal to or greater than 80° C. and less than 95° C., for 40 minutes, the spinning dope is obtained. Then at a temperature Tj of between 50° C. and 70° C. leave standing for a duration tj of between 180 and 200 minutes in order to allow deaeration. After deaeration and further filtration the spinning dope is introduced to the wet-spinning frame for wet-spinning.

The fibre-forming machine spinneret velocity V is 29.8 m/min. After injection the thread enters the coagulant bath, and the coagulant bath comprises a salt and acid aqueous solution, the salt content per liter being P, the acid content per liter being P1, the salt being sodium sulphate, the acid being sulphuric acid. The content P of sodium sulphate within this bath is between 439 g/L and 450 g/L, the content P1 of sulphuric acid in this bath is between 0.2 g/L and 0.25 g/L, and the temperature T3 of the solution is between 30° C. and 36° C. After passing through the coagulant bath the filament bundle is subjected to air drafting to an elongation factor of 2, and after undergoing air drafting the filament bundle enters the fluid bath trough to undergo wet bath drafting, the fluid within the trough consisting of an aqueous solution containing sodium sulphate, the sodium sulphate content of that solution being 440 g/L and the temperature of the solution being between 43.5° C. and 55° C., with the wet drafting elongation factor for the filament bundle in the trough being 1.5. After undergoing wet bath drafting the filament bundle enters the dry heat drafting and heat fixing stage, with the surface temperature of the filament bundle reaching 121° C. in the first heat chamber, 211° C. in the second heat chamber, 228° in the third heat chamber, 240° C. in the fourth heat chamber and 230° C. in the fifth heat chamber, with dry heat drafting taking place between heat chambers two and three, the dry heat drafting elongation factor being 2, yielding a total elongation factor for the three draftings of 5.5, with the semi-finished product being obtained after further heat drafting and heat fixing and the final product being obtained after acetalization and finishing of the semi-finished product. The finishing stages firstly require crimping, cutting and then acetalization, with the acetalization temperature T6 in the case of this example being between 40° C. and 64° C., whilst the acetalizing solution is a solution of aldehyde, sulphuric acid and ammonium sulphate, of which the aldehyde content P3 is between 5 g/L and 31 g/L, the sulphuric acid content P10 is between 150 g/L and 200 g/L and the ammonium sulphate content P11 is 118 g/L. After acetalizing, the filament bundle is rinsed again, and the phytoprotein synthetic fibre obtained after oiling and drying, at which stage it is ready for packaging and distribution.

EXAMPLE 2

Firstly, peanuts are chosen as the raw material for the purpose of extracting the phytoprotein, and pure protein is extracted from the peanuts using crushing, degreasing and soaking methods.

Following this, the purified extracted protein is dissolved in distilled water, giving a protein solution with a concentration As, where As is between 10% and 14.9%.

Polyvinyl alcohol is dissolved in distilled water at a temperature T1 of between 40° C. and 60°, the solution time being 2.8 hours, yielding an aqueous solution with a concentration Bs, where Bs is greater than 20% and equal to or less than 30%.

Taking the proportioned aqueous solutions of the above two materials, a mixed liquor of the two solutions is prepared, the proportion of pure protein to total, pure protein and polyvinyl alcohol being A parts, where A is 5 parts, and the proportion of polyvinyl alcohol to the total content of the two materials being B parts, where B is 95 parts, then by mixing the liquor thoroughly, and adding borax, and stirring at a temperature T4 of between 90° C. and 94° C., the spinning dope is obtained.

The spinning dope, of a viscosity, measured by a gravitational flow viscosimeter, of between 34 and 250 seconds, is subjected to deaeration by standing at a temperature Tj equal to or greater than 70° C. and less than 80° C. for between 180 and 230 minutes. After deaeration the spinning dope is subjected to wet-spinning, whilst spinneret velocity V is greater than 17 m/min and equal to or less than 25 m/min. After injection the thread enters the coagulant bath, the coagulant bath consisting of a salt and alkali aqueous solution, with a salt content per liter P and an alkali content per liter P4. The salt is sodium chloride, P being between 450 g/L and 460 g/L, and the alkali is sodium hydroxide, P4 being between 1 g/L and 40 g/L, with the temperature of the solution being between 32° C. and 36° C. After passing through the coagulant bath the filament bundle is subjected to air drafting to an elongation factor of 2.5, then after undergoing air drafting the filament bundle enters the fluid bath trough to undergo wet bath drafting, the fluid within the trough consisting of an aqueous solution containing sodium chloride, the sodium chloride content of the solution being 380 g/L and the temperature of the bath fluid being 88° C., with the wet drafting elongation factor for the filament bundle passing through the trough being 2. After undergoing wet bath drafting the filament bundle enters the heating and drying stage, with the surface temperature of the filament bundle reaching between 131° C. and 140° C. in the first heat chamber, between 220° C. and 230° C. in the second heat chamber, between 237° and 250° C. in the third heat chamber, between 241° C. and 250° C. in the fourth heat chamber and between 231° C. and 240° C. in the fifth heat chamber, with dry heat drafting taking place between heat chambers two and three, the dry heat drafting elongation factor being 2, yielding a total elongation factor for the three draftings of 6.5, with the semi-finished product being obtained after further heat drafting and heat fixing, the final product being obtained after acetalization and finishing of the semi-finished product. The finishing stages firstly require crimping, cutting and then acetalization, with the acetalization temperature T6 in the case of this example being equal to or greater than 50° C. and less than 64° C., whilst the acetalizing solution uses a solution of sulphuric acid, anhydrous sodium sulphate and modified glutaraldehyde, of which the salt content per liter is P11, the aldehyde content per liter is P3 and the acid content per liter is P10, where the aldehyde content P3 is equal to or greater than 15 g/L and less than 31 g/L, the sulphuric acid content P10 is between 18 g/L and 150 g/L and the anhydrous sodium sulphate content P11 is between 80 and 100 g/L. After acetalizing, the filament bundle is rinsed again, and the final product obtained after oiling and drying, at which stage it is ready for packaging and distribution.

EXAMPLE 3

Soya beans are chosen as the raw material for the purpose of extracting the phytoprotein, and protein is isolated and extracted from the peanuts using crushing, degreasing and soaking methods.

Taking the pure protein and polyvinyl alcohol, they are dissolved together in distilled water to a proportion of A parts of pure protein, where A is 7 parts, and B parts of polyvinyl alcohol, where B is 93 parts, and the two materials are mixed together at a temperature T4, where T4 is equal to or greater than 90° C. and less than 98° C., yielding a solution with a concentration C2 of protein and polyvinyl alcohol, where C2 is between 20% and 25%, then by adding borax and mixing the spinning dope with a pH value of between 1 and 2 is obtained. The spinning dope of a viscosity, measured by a gravitational flow viscosimeter, of between 34 and 250 seconds, is subjected to deaeration by standing at atmospheric pressure at a temperature Tj between 50° C. and 60° C. and for a time tj equal to or greater than 230 minutes and less than 240 minutes. After deaeration the spinning dope is subjected to filtration, and then enters the wet-spinning frame. Spinneret velocity V of the wet-spinning frame is 24 m/min. After injection the thread enters the coagulant bath, the coagulant bath being alkaline, and being an aqueous solution of a salt and an alkali, the salt being sodium sulphate, the alkali being potassium hydroxide. The pH of the coagulant bath is between 0.9 and 12, with the temperature T3 of the solution being equal to or greater than 36° C. and less than 38° C. After passing through the coagulant bath the filament bundle is subjected to air drafting to an elongation factor of 3, and after undergoing air drafting, the filament bundle enters the fluid bath trough to undergo wet bath drafting, the fluid within the trough consisting of an aqueous solution containing sodium sulphate, the sodium sulphate content of the solution being 400 g/L and the temperature of the bath fluid being between 38° C. and 80° C., with the wet drafting elongation factor for the filament bundle in the trough being 3. After undergoing wet bath drafting the filament bundle enters the dry heat drafting and heat fixing stage, with the surface temperature of the filament bundle reaching between 141° C. and 180° C. in the first heat chamber, between 231° C. and 250° C. in the second heat chamber, between 251° C. and 260° C. in the third heat chamber, between 351° C. and 260° C. in the fourth heat chamber and between 241° C. and 250° C. in the fifth heat chamber, with dry heat drafting taking place between the second and the third heat chamber, the dry heat drafting elongation factor being 1.5, yielding a total elongation factor for the three draftings of 7.5, with the semi-finished product being obtained after dry heat drafting, heat fixing, rinsing and acetalization, with the acetalization temperature T6 in the case of this example being equal to or greater than 54° C. and less than 64° C. and the acetalizing solution having a formaldehyde content P3, where P3 is equal to or greater than 20 g/L and less than 32 g/L, and having a sulphuric acid content P10, where P10 is between 200 g/L and 239 g/L, and an anhydrous sodium sulphate content P11, where P11 is between 80 g/L and 110 g/L. After acetalizing, the filament bundle is rinsed again, and the final product obtained after oiling, drying, crimping, fixing and cutting, at which stage it is ready for packaging and distribution.

EXAMPLE 4

Protein extracted and isolated from cottonseed cake is chosen and added to an acidic solution with a PH of between 1 and 2, and allowed to dissolve at a temperature T2 of between 60° C. and 90° C., the concentration As of the protein solution being between 4% and 10%. A certain quantity of the protein solution is taken, and a quantity of B part of polyvinyl alcohol, where B part is 90 parts of the total content of pure protein and polyvinyl alcohol, (pure protein being 10 parts of the total quantity), is measured out. The pure polyvinyl alcohol is added to the protein solution, and mixing then takes place at a temperature T4, where T4 is equal to or greater than 75° C. and less than 96° C., causing the pure polyvinyl alcohol to dissolve in the protein solution, yielding a spinning dope consisting of a solution of protein and polyvinyl alcohol with a total concentration C2 of between 8% and 18%, After deaeration for 3.5 hours at atmospheric pressure at a temperature tj equal to or greater than 30° C. and less than 58° C., or after vacuum deaeration, and after filtration, the spinning dope enters the wet-spinning frame and wet-spinning is carried out, with a spinneret velocity V of between 18 m/min and 28 m/min. After injection the thread enters the coagulant bath, the coagulant bath consisting of a salt and alkali aqueous solution, the salt being sodium sulphate, the alkali being potassium hydroxide, the temperature of fluid bath T3 being between 36° C. and 37.9° C., and the pH being between 9 and 12. After passing through the coagulant bath the filament bundle is subjected to air drafting to an elongation factor of 2.4, and after undergoing air drafting the filament bundle enters the fluid bath trough to undergo wet bath drafting, the fluid within the trough consisting of an aqueous solution containing ammonium sulphate, the ammonium sulphate content of the solution being 380 g/L and the temperature of the solution being between 35° C. and 38° C., with the wet drafting elongation factor for the filament bundle in the trough being 3. After undergoing wet bath drafting the filament bundle enters the dry heat drafting and heat fixing stage, with the surface temperature of the filament bundle reaching between 181° C. and 200° C. in the first heat chamber, between 251° C. and 260° C. in the second heat chamber, 261° C. in the third heat chamber, between 254° C. and 258° C. in the fourth heat chamber and 245° C. in the fifth heat chamber, with dry heat drafting taking place between the second and the third heat chamber, the elongation factor being 1.6, yielding a total elongation factor for the three draftings of 8, the steps and technical parameters employed following the heat drying and drafting being identical to example 2 and not requiring further detailed explanation.

EXAMPLE 5

In this case, use is made of protein extracted and isolated by pressing, degreasing and soaking cottonseed germ, the proportions of pure protein and polyvinyl alcohol being such that pure protein is A parts of the total content of both materials, where A is 13 parts, and polyvinyl alcohol is B parts, where B is 87 parts. These are dissolved together in distilled water, and mixed at a temperature T4 of between 40° C. and 78° C., forming a solution with a concentration C2 of total protein and polyvinyl alcohol of between 8% and 16%. After the addition of boric acid and further stirring, the pH of the solution then being between 1 and 2.5, the spinning dope is obtained at a temperature of between 40° C. and 58° C., the spinning dope being deaerated by standing for a time tj of between 100 and 238 minutes at atmospheric pressure, or by vacuum deaeration at a temperature of between 30° C. and 40° C., the spinning dope then being subjected to wet-spinning after deaeration and filtration, with a spinneret velocity V of between 17 m/min and 25 m/min. After injection the thread enters the coagulant bath, the coagulant bath consisting of a salt and alkali aqueous solution, the salt being sodium sulphate, the alkali being sodium hydroxide. The content P of sodium sulphate in the fluid bath is between 428 g/L and 450 g/L, and the content P4 of sodium hydroxide contained in the bath fluid is between 1 g/L and 40 g/L, yielding a total elongation factor of 4.5 for this example, the air drafting elongation factor being 1.5, the wet drafting elongation factor being 1.5 and the elongation factor occurring between heat chambers 2 and 3 being 1.5, and the remaining steps and technical conditions employed being identical to example 3, and not requiring further detailed explanation. The boric acid used in this implementation may be replaced by borax and/or phosphoric acid.

EXAMPLE 6

A protein solution with a concentration As, where As equal to or greater than 4% and less than 15%, is first prepared, the pH of the solution being greater than 7.5 and less than 8.5. A proportion of polyvinyl alcohol is then measured out and dissolved directly in the prepared protein solution, with the result that protein is A parts of the total content of these two materials, where A is 13, and polyvinyl alcohol is B parts, where B is 87 parts. Dissolution is then allowed to take place at a temperature Th of between 40° C. and 98° C. for a time t, where t is equal to or greater than 1 hour and less than 4 hours, yielding a spinning dope with a concentration C2, where C2 is equal to or greater than 8% and less than 15%, or where C2 is greater than 20% and equal to or less than 30%. Vacuum deaeration is then carried out at a temperature of between 20° C. and 35° C. or static deaeration is carried out at a temperature Tj greater than or equal to 35° C. and less than 80° C. Finally wet-spinning is carried out, the fibre output from the fibre forming machine entering an acidic solution, and the remaining steps of this example being the same as in example 1.

In addition, the protein used in this example is a mixture of phytoproteins extracted and isolated from soya beans, cottonseed and rapeseed which have been individually soaked and wet ground.

EXAMPLE 7

Pure protein and polyvinyl alcohol are measured out in proportion, with pure protein being A parts of the total content of these two materials, where A is 17 parts, and polyvinyl alcohol being B parts, where B is 83 parts. Then, by dissolving the two together in distilled water, and after the addition of borax, and after mixing at a temperature T4 of between 40° C. and 98° C., the spinning dope is obtained after the solution has been static deaerated by being left to stand for between 1.5 and 4 hours at a temperature Tj of between 50° C. and 79.5° C. at normal atmospheric pressure or vacuum deaerated by being left to stand at a temperature of between 35° C. and 40° C. The coagulant bath that the injected thread enters is a salt and alkali aqueous solution, the content P of sodium chloride in the fluid bath being between 450 g/L and 460 g/L, and the content P4 of sodium hydroxide contained in the fluid bath being between 1 g/L and 40 g/L, whilst the fluid bath temperature T3 is between 32° C. and 36° C. The other steps and technical conditions in this example are the same as in example 2.

EXAMPLE 8

The protein used in this case is the phytoprotein isolated, extracted and produced from cottonseed cake. The pure protein is added to a weak alkaline solution with a pH value of 7.5, and dissolved at a temperature T2 of between 55° C. and 75° C. for a period t2 of 1.5 hours, to yield a pure protein solution with a concentration As between 12% and 14.9%; polyvinyl alcohol is dissolved in distilled water at a temperature T1 of between 40° C. and 60° C. for 110 minutes, to yield a solution with Bs of between 25% and 29.5%.s The above two solutions are mixed in a certain proportion, with pure protein forming 22 (A) parts of the total pure protein and polyvinyl alcohol, and with polyvinyl alcohol forming 78 (B) parts of the total by weight; at a temperature T4 of 94° C. and mixing for 50 minutes, to yield the spinning dope. Vacuum deaeration is then carried out at a temperature between 35° C. and 45° C., and the deaerated and filtered spinning dope then enters the wet-spinning frame to undergo wet-spinning. The fibre-forming machine spinneret velocity V is 19 m/min, the injected thread then entering a coagulant bath, the coagulant bath being a salt and acid aqueous solution, the salt used being sodium sulphate, the acid being sulphuric acid. The content of sodium sulphate P in the fluid bath is between 450 g/L and 480 g/L, the content of sulphuric acid P1 is between 0.25 g/L and 0.258 g/L, and the bath temperature is T3, where T3 is equal to or greater than 32° C. and less than 38° C. The remaining processing stages and technical conditions being identical to those in example 1.

EXAMPLE 9

The protein used in this case is the phytoprotein isolated and extracted by pressing, grinding and degreasing cottonseed germ. The protein obtained is added to a weak alkaline solution with a pH of 8, and allowed to dissolve at a temperature T2 of between 80° C. and 98° C. for 2 hours, yielding a pure protein solution with a concentration As, where As is equal to or greater than 12% and less than 15%; polyvinyl alcohol is dissolved at a temperature T1 of between 55° C. and 75° C. for 1 hour, to yield a solution with a concentration Bs, where Bs is equal to or greater than 10% and less than 15%.

The above two solutions are mixed in a certain proportion, with pure protein forming A parts of the total pure protein and polyvinyl alcohol, where A is 18 parts, and with polyvinyl alcohol forming B parts of the total content, where B is 82 parts, at a temperature T4 of 94° C. to yield the spinning dope. Deaeration is then carried out by standing at normal atmospheric pressure for between 180 and 200 minutes at a temperature Tj equal to or greater than 70° C. and less than 80° C. The deaerated spinning dope is then subjected to filtration and enters the wet-spinning frame to undergo wet-spinning.

The fibre-forming machine spinneret velocity V is between 20 m/min and 25 m/min, the injected thread then entering a coagulant bath, the coagulant bath being a salt and acid aqueous solution, the salt used being sodium sulphate, the acid being sulphuric acid. The content of sodium sulphate P in the fluid bath is between 440 g/L and 450 g/L, the content of sulphuric acid P1 is between 0.2 g/L and 0.25 g/L, and the bath temperature is T3, where T3 is equal to or greater than 32° C. and less than 38° C. The remaining processing stages and technical conditions are identical to those in example 1.

EXAMPLE 10

The pure protein used in this case is the phytoprotein isolated and extracted by the grinding, degreasing and soaking of rapeseed, the extracted protein being dissolved in distilled water, resulting in a protein concentration As of between 4% and 8%.

By dissolving polyvinyl alcohol in distilled water for 1.5 hours at a temperature T1 of between 60° C. and 80° C., an aqueous solution with a concentration Bs is obtained, where Bs is equal to or greater than 8% and less than 15%.

Mixing the above two solutions in a certain proportion, with pure protein forming A parts of the total pure protein and polyvinyl alcohol, where A is 21 parts, and with polyvinyl alcohol forming B parts of the total, where B is 79 parts, and by adding borax, and mixing at a temperature T4 of between 40° C. and 90° C., the spinning dope is obtained.

The spinning dope, of a viscosity, measured by a gravitational flow viscosimeter, of between 34 and 150 seconds, is subjected to static deaeration by standing at a temperature Tj of between 50° C. and 70° C. for between 1.5 and 3 hours at normal atmospheric pressure (or is subjected to vacuum deaeration at a temperature of between 30° C. and 40° C.). After deaeration the spinning dope is subjected to wet-spinning, whilst spinneret velocity V is equal to or greater than 25 m/min and less than 30 m/min. The injected thread then enters a coagulant bath consisting of a salt and alkali aqueous solution. The sodium chloride content is between 450 g/L and 460 g/L, the sodium hydroxide content P4 is between 1 g/L and 40 g/L, and the fluid bath is at a temperature T3, where T3 is equal to or greater than 36° C. and less than 38° C. The remaining processing stages and technical conditions are identical to those in example 2.

EXAMPLE 11

The pure protein used in this case is the phytoprotein isolated and extracted by the grinding, degreasing and soaking of soya beans.

Pure protein and polyvinyl alcohol, with pure protein forming A parts of the total pure protein and polyvinyl alcohol, where A is 10 parts, and with polyvinyl alcohol forming B parts, where B is 90 parts, are taken and dissolved in distilled water, and mixed at a temperature T4 of between 40° C. and 79° C., to yield a solution containing a concentration C2 of protein and polyvinyl alcohol of between 14% and 18%, and by adding boric acid and mixing, spinning dope with a pH of between 2 and 3.5 is obtained.

The spinning dope, of a viscosity, measured by a gravitational flow viscosimeter, of between 34 and 250 seconds, is subjected to vacuum deaeration at a temperature of between 30° C. and 45° C., and after deaeration and filtration the spinning dope enters the wet-spinning frame. Spinneret velocity V is 20 m/min, the injected thread then entering a coagulant bath, the coagulant bath fluid consisting of a salt and alkali aqueous solution, where the salt is sodium sulphate and the alkali is sodium hydroxide, the fluid bath having a pH of between 12 and 14, and a temperature T3 of 36° C. The remaining processing stages and technical conditions are identical to those in example 3.

EXAMPLE 12

Protein extracted from cottonseed cake is used, and added to an acidic solution with a pH of between 2 and 3.5, and allowed to dissolve at a temperature T2 of between 45° C. and 60° C., this protein solution having a concentration As, where As is equal to or greater than 10% and less than 15%. Pure polyvinyl alcohol is added directly to the protein solution in the proportion of B parts of the total protein and polyvinyl alcohol, where B is 84 parts (with the proportion of protein being 16 parts). This is then mixed at a temperature T4 of between 60° C. and 75° C., causing the pure polyvinyl alcohol to dissolve in the protein solution, yielding a spinning dope containing a total protein and polyvinyl alcohol content of between 18% and 22%, and a viscosity of between 34 and 250/sec. This is then subjected to static deaeration at normal atmospheric pressure at a temperature of between 30° C. and 58° C. for 3.5 hours or is subjected to vacuum deaeration, to yield the spinning dope. After filtration this then enters the wet-spinning frame to undergo wet-spinning, spinneret velocity v being between 18 m/min and 29.5 m/min. The injected thread then enters a coagulant bath, the coagulant bath fluid consisting of a salt and alkali aqueous solution, where the salt is sodium sulphate, and the alkali potassium hydroxide. The temperature T3 of the bath is equal to or greater than 36° C. and less than 38° C., and the pH is between 12 and 14. The remaining processing stages and technical conditions are identical to those in example 4.

EXAMPLE 13

The pure protein used in this case is that isolated and extracted by the pressing, soaking and degreasing of rapeseed, Pure protein and polyvinyl alcohol are then measured out, with pure protein being A parts of the total content of these two materials, where A is 19 parts, and polyvinyl alcohol being B parts, where B is 81 parts, then by dissolving the two together in distilled water, and after mixing at a temperature T4 of between 78° C. and 97° C., a solution with a total protein and polyvinyl alcohol concentration of between, 15% and 22% is obtained. Boric acid is added to this solution, and mixing continued, giving a pH of between 2.5 and 3.5, after which the spinning dope is obtained at a temperature Tj, where Tj is equal to or greater than 58° C. and less than 80° C. This is then subjected to deaeration by standing at normal atmospheric pressure for a period tj of between 100 and 240 minutes, or alternatively vacuum deaeration may be carried out at a temperature between 30° C. and 45° C. Then, after filtration, the spinning dope enters the wet-spinning frame to undergo wet-spinning, spinneret velocity V being greater than 17 m/min and less than 30 m/min. The injected thread then enters a coagulant bath consisting of a salt and alkali aqueous solution, where the salt is sodium sulphate, and the alkali is sodium hydroxide. The content P of sodium sulphate in the fluid bath is between 428 g/L and 450 g/L, and the sodium hydroxide content P4 is between 1 g/L and 40 g/L, yielding a total elongation factor for this example of 8.5, of which air drafting contributes 3 elongation factors, wet bath drafting contributing 2.5 elongation factors and drafting occurring between the second and third heat chambers contributing an elongation factor of 1.5.

The remaining processing stages and technical conditions are identical to those in example 5.

In all of the examples disclosed by this invention the protein used may be that isolated and extracted directly from soya beans, peanuts, cottonseed or rapeseed by soaking and wet grinding, or that protein isolated and extracted by crushing, degreasing and soaking, or that protein isolated by germ pressing, fragmentation and degreasing. It is also possible to use protein isolated and extracted from soya bean or peanut or cottonseed or rapeseed cake. In addition, protein obtained and prepared in any other form may be used. The quantities of protein and polyvinyl alcohol in the solutions is based on pure dry solid content.

What is claimed is:

1. Phytoprotein synthetic fibre comprising phytoprotein and polyvinyl alcohol, wherein said phytoprotein is present in an amount of from 5 parts to 19 parts, and said polyvinyl alcohol is present in an amount of from 81 parts to 95 parts based on dry solid content.

2. The phytoprotein synthetic fibre as claimed in claim 1, wherein said phytoprotein is present in an amount of from about 6 parts to about 18 parts, and said polyvinyl alcohol is present in an amount from about 82 parts to about 94 parts based on the dry solid content.

3. The phytoprotein synthetic fibre as claimed in claim 1, wherein the phytoprotein is an isolated extract of soya beans, peanuts, cottonseed, rapeseed cake, maize germ, walnuts, or sunflower seeds.

4. The phytoprotein synthetic fibre as claimed in claim 1, wherein the phytoprotein is isolated and extracted from soya beans, of peanuts, cottonseed, rapeseed by soaking and wet grinding.

5. The phytoprotein synthetic fibre as claimed in claim 1, wherein the phytoprotein is isolated and extracted directly from soya beans, peanuts, cottonseed, or rapeseed by crushing, degreasing and soaking.

6. The phytoprotein synthetic fibre as claimed in claim 1, wherein the phytoprotein is isolated and extracted directly from soya beans, peanuts, cottonseed, or rapeseed by germ pressing, fragmentation and degreasing.

* * * * *